US005279644A

United States Patent [19]

Francisco

[11] Patent Number: 5,279,644

[45] Date of Patent: Jan. 18, 1994

[54] FIRE REFINING PRECIOUS METALS ASAY METHOD

[75] Inventor: David W. Francisco, Beatty, Nev.

[73] Assignee: ASARCO Incorporated, New York, N.Y.

[21] Appl. No.: 19,380

[22] Filed: Feb. 18, 1993

[51] Int. Cl.[5] ..... C22B 11/02

[52] U.S. Cl. ..... 75/631; 75/632; 75/633; 75/634; 75/637

[58] Field of Search ..... 75/631-637

[56] References Cited

U.S. PATENT DOCUMENTS 4,497,658 2/1985 Woog ..... 75/636

FOREIGN PATENT DOCUMENTS 3203727 8/1988 Japan ..... 75/634

4234 of 1899 United Kingdom ..... 75/631

*Primary Examiner*—Melvyn J. Andrews

*Attorney, Agent, or Firm*—John J. Tomaszewski; Kenneth A. Koch

[57] ABSTRACT

A new environmentally safe fire refining precious metal assay method is provided wherein bismuth oxide is used with a special flux composition as the precious metal collector and the cupelling procedure is performed in a controlled temperature range.

3 Claims, No Drawings

FIRE REFINING PRECIOUS METALS ASAY METHOD

BACKGROUND OF THE INVENTION

The present invention relates to a method for recovering precious metals from metallurgical products such as ores, wastes and electrolytic slimes and, more particularly, to an improved fire refining precious metal assay method for these materials.

The need for separating precious metals from materials such as ores is well-known. As discussed in U.S. Pat. No. 4,643,365, there are long known methods in the prior art for processing different types of precious-metal containing materials using lead as a collector for the precious metals recovered. Thus, in U.S. Pat. No. 718,087 silver and gold are recovered from their ores in a two-stage process comprising reverberatory smelting with molten lead. U.S. Pat. No. 815,851 teaches smelting hydrometallurgical products containing precious metals with litharge and reductant and cupelling the formed lead precious metals alloy product. U.S. Pat. No. 415,526 discloses a process for separating Se and other elements of the sulphur group and noble metals from each other by fusion with a collector, such as lead, for the noble metals. GB-A-689824 discloses extraction of precious metals from ashes or residues, for example, goldsmith's ashes and copper electrolysis sludge using a lead compound. GB-A-1574274 relates to smelting of waste products in a blast furnace with lead oxide and coke to form a lead smelt containing any precious metals. The above patents are hereby incorporated by reference.

In the fire refining assay process the precious metal containing material is mixed with a flux containing litharge (lead oxide), a reducing source, usually a carbon material, and fused in a furnace. At the temperature of the furnace, the carbon monoxide given off by the carbon source reduces the lead oxides to form metallic lead which rains down through the molten mass and acts as a solvent and collector for the precious metals. The mixture is poured into a mold to cool, forming a lead-precious metal alloy button and a slag. The slag is removed leaving the button which is then cupelled at about 954° C. to absorb the lead and/or the drive off the lead as lead oxide leaving the precious metals which can then be conveniently assayed by, e.g., gravimetric means.

Collectors other than lead have been used in the prior art. U.S. Pat. No. 1,896,807 discloses the use of copper and iron and U.S. Pat. No. 2,048,152 discloses the use of nonmetals silicon, phosphorous and boron. Copper, nickel and iron are used as collectors in U.S. Pat. Nos. 4,448,604 and 4,451,290.

In "Notes on Assaying and Metallurgical Laboratory Experiments" by R. W. Lodge, John Wiley and Sons, 1906, pages 47 and 48, a different assaying process called scorification is described wherein bismuth is suggested as the only metal that could be used to take the place of lead in the assaying of ores for silver. It is noted though that silver losses are very high and other problems are encountered when using bismuth.

While the prior art methods of fire refining assaying are useful, the need still exists for more efficient methods of assaying and, in particular, for environmentally safe methods which do not use lead as the collector metal.

It is an object of the present invention to provide an environmentally safe method for the recovering of precious metals from precious metal containing materials.

It is a further object of this invention to provide an environmentally safe method for the fire refining precious metal assay method.

Other objects and advantages will become apparent for the following detailed description.

SUMMARY OF THE INVENTION

It has been found that precious metals may be separated and recovered from metallurgical materials by a pyrometallurgical process using bismuth oxide to separate and collect the precious metals from the material. A preferred embodiment of the invention is an improvement of the fire refining precious metal assay method wherein bismuth oxide is used in place of the known lead oxide (litharge) material. It is important when using bismuth oxide that a special flux be employed and the cupellation temperature be controlled at below about 940° C., preferably below about 900° C.

DETAILED DESCRIPTION OF THE INVENTION

Any suitable precious metal containing material may be employed using the method of the invention and such materials include metallurgical products such as ores, concentrates, slags, etc. Precious metals include but are not limited to gold, silver, platinum, palladium and other platinum group metals.

For convenience, the following description will be directed to an assaying procedure as compared to the separation of precious metals for recovery purposes.

Generally, a sample of the material to be assayed is taken, such as a one assay ton equivalent (29.167 grams), which is then pulverized and placed into an assay crucible, e.g., a clay vessel.

To achieve the high precious metal recoveries needed for an assay procedure, it is preferred that the following flux be used, which flux has demonstrated excellent results (bismuth oxide is included as part of the flux composition):

| Material | % by Weight | Broad Range | Preferred Range |
|---|---|---|---|
| Bismuth oxide ($Bi_2O_3$) | 29.0 | 10–80 | 15–40 |
| Soda ash ($Na_2CO_3$) | 60.2 | 30–70 | 45–70 |
| Silica ($SiO_2$) | 2.7 | 1–10 | 1.5–4 |
| Borax ($Na_2B_4O_7$) | 5.4 | 1–10 | 3–6.5 |
| Fluorspar ($CaF_2$) | 2.7 | 1–10 | 1.5–4 |

Flux is added to the sample, e.g., 120 grams. A flux to sample weight ratio of about 10:1 to 2:1 may be employed with a preferred range being about 3:1 to 5:1, e.g., 4:1. Also added to the assay crucible is any suitable reducing agent, such as a carbonaceous material like cooking flour. Usually about 2 to 6 grams are added, e.g., 3.75 and the amount used generally corresponds to the stoichiometric amount needed to completely reduce the amount of bismuth oxide used in the flux. A material such as silver as an inquart is usually added to insure that the final bead size is adequate for handling and/or that there may be none or very little precious metals in the sample. An amount of about 2–10 milligrams, e.g., 3.8 mgs. of silver has produced excellent results. Additionally, to enhance the separation of the gold from the silver in the collected precious metal alloy, a weight ratio of about 2.5 silver: 1 gold is desired. All the ingredients are then thoroughly mixed for even distribution.

The mixture is fused in a furnace at about 815° to 1093° C., e.g., 1010° C. for 30 to 60 minutes, e.g., 45 minutes. During fusion, the bismuth oxide reacts with the carbon reductant and is reduced to bismuth metal which results in a simultaneous precious metal collection in the bismuth as the bismuth metal rains down through the melt. The molten mass is poured hot into a mold, preferably a pour bar, for cooling. Upon cooling, the bismuth-precious metal collection button is removed from the slag by impact.

The cupellation begins by loading the metallic button into a porous vessel (cupel) which has been preheated to about 900° C. This temperature is important to the amount of precious metal recovery (100% being ideal) and a range of about 870° to 940° C. for generally 15 to 60 minutes has provided excellent results. The time depends on the amount of air and sample and temperature as will be appreciated by those skilled in the art. This temperature range control has been found to reduce the precious metal losses during the cupellation process and is essential to a substantially complete precious metal extraction efficiency. After approximately 30 minutes, the cupel absorbs nearly 98 percent of the bismuth with about 2 percent being driven off as bismuth oxide. The resulting dore bead contains the precious metals originally found in the sample. An instrumental, gravimetric or other evaluation of the bead provides an accurate and reliable precious metal, e.g., gold, determination. Unlike the prior art, the present invention provides a safe and environmentally sound technique for the mining and metallurgy industry.

The above described procedure employing bismuth oxide was compared with the prior art litharge process for twenty-five samples containing about 0.0005% by weight gold and there was no statistical difference in the gold assay results between the two methods.

It will be apparent that many changes and modifications of the several features described herein may be made without departing from the spirit and scope of the invention. It is, therefore, apparent that the foregoing description is by way of illustration of the invention rather than limitation of the invention.

I claim:

1. A method for separating precious metals from metallurgical materials comprising:
   (a) fusing a mixture of the material, a reducing agent, bismuth oxide and a flux;
   (b) cooling the fused mixture to form a solid mass of a bismuth-precious metal alloy and a slag; and
   (c) separating the formed bismuth-precious metal alloy from the slag.

2. An assay method to determine the amount of precious metals contained in a material comprising:
   (a) fusing a mixture of the precious metal containing material, a reducing agent, bismuth oxide and a flux;
   (b) cooling the fused mixture to form a solid mass of a bismuth-precious metal alloy and a slag;
   (c) separating the formed bismuth precious metal alloy from the solid mass;
   (d) cupelling the alloy at a temperature below about 940° C. until the bismuth is separated leaving the precious metals.

3. The method of claim 2 wherein the bismuth-flux mixture comprises, by weight, about 10% to 80% bismuth oxide, about 30% to 70% soda ash, about 1% to 10% silica, about 1% to 10% borax and about 1% to 10% fluorspar.

* * * * *